United States Patent [19]

Shaw

[11] Patent Number: 4,837,991

[45] Date of Patent: Jun. 13, 1989

[54] CHANNEL MEANS FOR USE IN CONJUNCTION WITH BUILDING FOOTING

[76] Inventor: Jack R. Shaw, 1247 Fox Creek Dr., St. Louis, Mo. 63126

[21] Appl. No.: 112,411

[22] Filed: Oct. 26, 1987

[51] Int. Cl.[4] ..... E04C 2/52; E04B 1/70

[52] U.S. Cl. ..... 52/98; 52/169.5; 52/274

[58] Field of Search ..... 52/169.5, 98, 274, 303, 52/716; 405/43, 229

[56] References Cited

U.S. PATENT DOCUMENTS

| | | | |
|---|---|---|---|
| 2,277,758 | 3/1942 | Hawkins | 52/98 |
| 2,889,016 | 6/1959 | Warren | 52/98 |
| 3,017,722 | 1/1962 | Smith | 52/169.5 |
| 3,287,866 | 11/1966 | Bevilacqua | 52/198 |
| 3,290,838 | 12/1966 | VanBael | 52/98 |
| 3,304,672 | 2/1967 | Bakke | 52/169.5 |
| 3,613,323 | 10/1971 | Hreha | 52/169.5 |
| 3,654,765 | 8/1973 | Healy | 52/169.5 X |
| 3,754,362 | 4/1972 | Daimler | 52/169.5 |
| 3,850,193 | 11/1974 | Guzzo | 52/169.5 |
| 3,888,087 | 6/1975 | Bergsland | 52/169.5 |
| 3,975,467 | 8/1976 | Beck | 52/169.5 |
| 4,075,800 | 2/1978 | Molick | 52/169.5 |
| 4,185,429 | 1/1980 | Mendola | 52/169.5 |
| 4,245,443 | 1/1981 | Beecham | 52/169.5 |
| 4,265,064 | 5/1981 | Parezo | 52/169.5 |
| 4,280,308 | 7/1981 | Svensson | 52/98 |
| 4,540,722 | 5/1986 | Bevelacqua | 52/169.5 |
| 4,660,333 | 4/1987 | Romer | 52/169.5 |

FOREIGN PATENT DOCUMENTS

| | | | |
|---|---|---|---|
| 107188 | 10/1965 | Norway | 52/169.5 |

*Primary Examiner*—David A. Scherbel
*Assistant Examiner*—Caroline D. Dennison
*Attorney, Agent, or Firm*—Paul M. Denk

[57] ABSTRACT

A hydro channel for use in conjunction and in proximity with the juncture between a foundation wall, and the upper surface of a connecting footing, the channel incorporating an angled portion, formed of a horizontal and vertical integral wall, a lower flange extends from the bottom edge of the vertical wall, a break away upright flange extends integrally from the upper edge of the upper wall, and once a concrete floor or slab is poured, and hardened, a portion of the upright flange may be broken away so as to align its upper edge in proximity with the upper surface of the constructed floor.

2 Claims, 1 Drawing Sheet

FIG. 1.
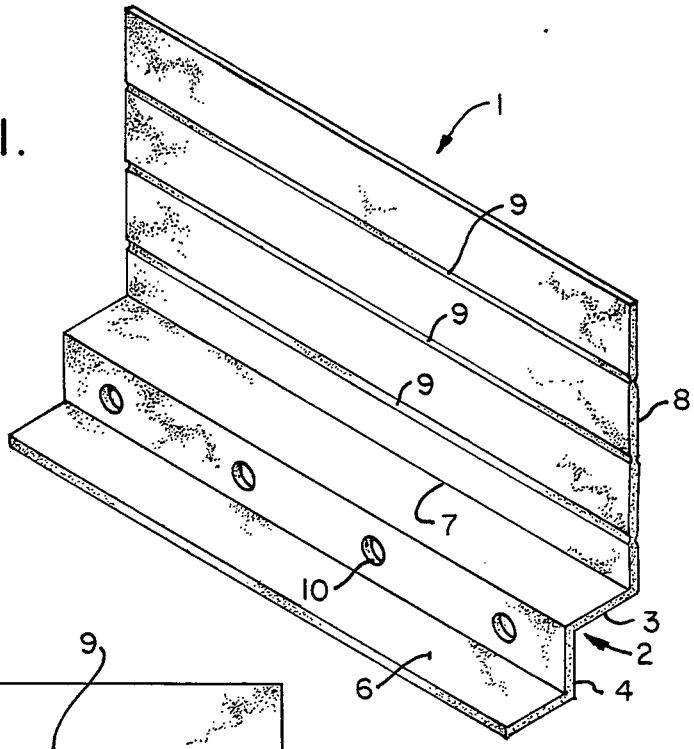
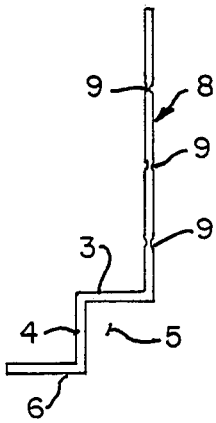
FIG. 2.
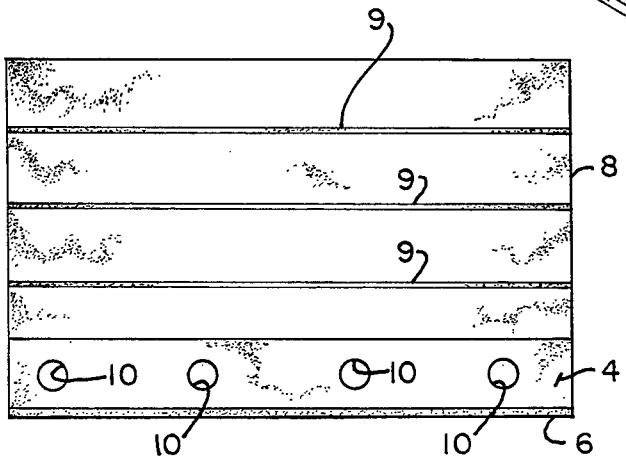
FIG. 3.
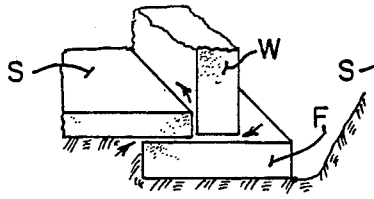
FIG. 4.
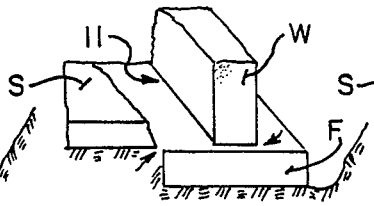
FIG. 5.
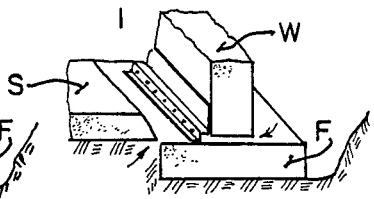
FIG. 6.
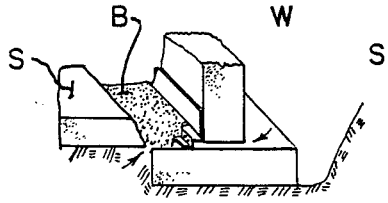
FIG. 7.
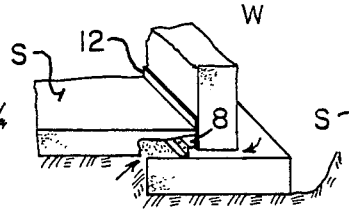
FIG. 8.
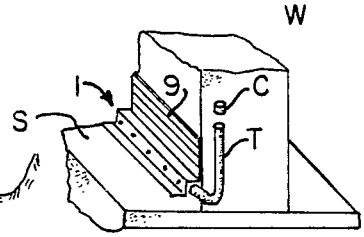
FIG. 9.

CHANNEL MEANS FOR USE IN CONJUNCTION WITH BUILDING FOOTING

BACKGROUND OF THE INVENTION

Various styles of drainage means as used in conjunction with building walls, and more particularly foundations, and specifically at the location of their footings, have long been available in the prior art. For example, as can be seen in the U. S. Pat. No. 3,850,193 to Guzzo, therein is disclosed an expansion joint and drain conduit for foundation walls. As can be noted, a conduit, formed basically as a channel member, but without any provided apertures, incorporates a vertical flange, in addition to a horizontal flange, to provide for its mounting against the formed wall, upon its footing. It is designed to provide clearance for receiving any drain off of moisture that enters into it, apparently through the drain holes as shown, as provided at the bottom of the concrete block course as disclosed constructed therein. It appears that the concrete slab forming the floor in the shown patent is arranged upon the aggregate located therebelow, and that the slab itself is not poured in conjunction with the location of the channel member as shown.

U.S. Pat. No. 3,017,722 to Smith, discloses the combination of a hollow footing stringer and foundation drain duct. The structure of this drain duct, as disclosed, is located generally at the exterior edge surface of the formed footing, and is designed incorporating a series of perforations, in order to allow for moisture to enter therein, and be drained away through the internal conduit formed of each duct.

U.S. Pat. No. 3,654,765 to Healy, discloses another variation upon a subterranean wall drain. As can be noted, the structure of this device is rather unique in that it includes a tubular pipe, having an integral and intended vertically extending sheet, which is formed having a series of spacers or core means arranged throughout its extent, to rigidify the structure of the device. As noted, there are various channels arranged between the various corrugations or plaits for the vertical portion of the channel, so that moisture can drain down therethrough and enter into a drainage pipe.

U.S. Pat. No. 3,754,362 to Daimler, shows a vertical drainage system, but once again, the drainage means includes a series of filter layers or web means, arranged along the exterior surface of the masonry wall, and having a proximity with its lower end a drain pipe, as shown.

U.S. Pat. No. 3,975,467 to Beck, discloses a baseboard drainage system. This device is rather complex of structure, as can be noted, and it appears to provide a drainage system incorporating a series of drain members, for disposition above the floor slab, and for eliminating any draining moisture, via its shown hose, for dispensing into a floor drain. But it does disclose and incorporates a generally L-shaped sheet metal member, incorporating a base flange and an upstanding leg flange, and having an orifice means therein.

U.S. Pat. No. 4,075,800 to Molick, shows a foundation aquaduct and expansion joint. This device, as can be noted, again is formed as a U-shaped duct, and is arranged adjacent the foundation wall, intermediate the floor, and having its drain off tube, for removal of any moisture for elimination through the drain tile, as noted.

U.S. Pat. No. 4,245,443 to Beechen, discloses another type of seepage control device. This device is designed for resting upon the interior of the footing, at the corner of the shown poured concrete floor, and is useful for preventing seepage through the wall from onto the floor, directing any moisture to be discharged through the various channels, and to the water permeable gravel bed, as disclosed.

U.S. Pat. No. 4,265,064 to Parezo, shows another form of water proofing system. In this particular instance, it does include a shaped channel member 10, generally formed of a polymer, and which is rested upon the floor, against the interior of the adjacent wall, and under the wall studding members. It is designed to take the moisture that seeps through the building wall, that may enter through the formed weep holes, and drain off that moisture through the drainage system as can be noted.

U.S. Pat. No. 4,280,308 to Svensson, discloses a form of lintel, but the structure of this device is intended for supporting arches, or other wall means, arranged above the doors, windows, or other openings of a building.

U.S. Pat. No. 4,590,722 to Bevelacqua, shows an improved drainage system for basements. The structure of this device apparently incorporates means, such as the bridge plates, as noted, that rest upon the drain tile, for supporting the proximate end of the poured basement floor, and for use for draining away moisture, and to prevent its seepage into the building. A tile incorporates a series of drain openings for allowing moisture to seep therein, and for discharge.

Another patent to Bevilacqua, U.S. Pat. No. 3,287,866, shows another form of foundation and wall drainage system.

Finally, the patent to Hawkings, U.S. Pat. No. 2,277,758, discloses a shield device, for use with electrical cable, but is revealed herein primarily because it discloses weakened lines provided upon its length to furnish it with frangible locations.

SUMMARY OF THE INVENTION

It is the principal object of this invention to provide what may be defined as a hydrochannel, one that is generally shaped in the form of an angel, or Z-bar, and incorporating integral flanges, and which is designed for resting upon a footing, in proximity with a poured floor slab, in order to afford a means for absorption and drain away of subsoil moisture, or to provide an area where flush out may be performed.

The basic concept of this invention is to provide a molded, or extruded, composition of material, which may be formed or rubber, a polymer, or even of a non-corrosive metal, and which is designed in the shape of an angle means, which when located in proximity and aligned with the juncture between the foundation wall, and its footing, provides a cavity or channel opening therealong, at said juncture, in order to provide an accessible area wherein moisture may drain, or perhaps water or other fluid may be flushed, to provide clean out at said location. The angle means of the channel is formed of a pair of walls, one comprising an upright wall, and the other integral wall formed as a horizontal or top wall. A lower flange integrally extends from the bottom edge of the upright wall, and provides stable support for resting of the entire channel means upon the upper surface of the footing, when located in place. Another flange extends upright, upwardly from the top wall of the angle means or channel, and is designed for resting flush against the vertical surface of the foundation wall, once again, to provide stability in the locating of this invention, when installed. One or more of the walls of the angle means, but preferably its upright wall, may include a series of apertures or slots therethrough, and through which moisture may migrate, as a means for collection of ground water that would normally and ordinarily creep into the basement, at the juncture between the footing and the poured floor slab, and provide a means for rapidly flowing away any accumulated moisture, at said location. In addition, the spacing within the formed channel may accommodate a flowage of water, or other fluid, to provide a means for flushing of this location, at the juncture of the footing, and its foundation wall, as may be desired. In addition, the upright flange of the channel means extends for some substantial distance, generally to the vicinity of the top of any poured slab or floor, and said upright flange further includes a series of longitudinally or horizontally disposed weakened lines, formed during its extrusion, so that the upper flange may be broken off, and removed, leaving only that height required to provide for its extension to and in proximity of the upper surface of any poured floor. In addition, this upright flange may likewise function as a flexture joint, in order to accommodate any expansion that may occur within the slab, the footing, or the like, as the result of temperature variations and changes.

It is a principal object of this invention to provide a channel means for installation at the key areas where water enters into a foundation, generally at the proximity of its footing and floor slab.

Another object of this invention is to provide a channel means that sets directly upon the top of a footing, rested against the side of any foundation wall, and therein provide means for allowing water or moisture that is accumulated to flow from the same.

A further object of this invention is to provide a channel means for use in conjunction with the footing, and which will sustain its integrity, due to its inherent strength, even when back filled with gravel.

A further object of this invention is to provide a channel means having a cavity formed therethrough, longitudinally of its locating in proximity with the footing and a foundation wall, and may be subject of the flowage of water delivered from a flush out tube, designed to clean out any debris that should enter into the channel subsequent to its installation.

A further object of this invention is to provide a channel means for use in conjunction with a footing, and which is designed for use with footings that may accommodate a variety of floor slabs of varying depth, with the channel means being breakable, to sever off those portions of its flanges that are unneeded after installation.

Yet another object of this invention is to provide an effective and cost reduced method to relieve hydrostatic pressure and foundation water problems.

Still another object of this invention is to provide a channel means which is formed and extruded of lightweight plastic, rubber, or the like, and which facilitates its installation as an efficient interior drainage system.

Still another object of this invention is a channel means for use for removal of hydrostatic and other moisture from a footing and its lower foundation wall, and because of its unique design is easy of placement, and very stable once installed.

Yet another object of this invention is to provide a channel means for use in conjunction with hydraulic ground water, so as to provide its ease of collection and passage of the accumulated water through its formed channel or cavity and to the pump station.

Another object of this invention is to provide a hydrochannel that allows for immediate flow of water, or ground water, that may permeate through gravel fill, providing for its quick disposal, thereby alleviating the causes of dampness.

These and other objects may become more apparent to those skilled in the art upon reviewing the description of the preferred embodiment of this invention, in view of its drawings.

BRIEF DESCRIPTION OF THE DRAWINGS

In referring to the drawings, FIG. 1 is an isometric view of the hydrochannel means of this invention;

FIG. 2 is an edge view thereof;

FIG. 3 is a front view thereof;

FIG. 4 discloses the method of installation of the hydrochannel of this invention, basically disclosing the location of the foundation wall, its footing, and the poured floor slab thereon;

FIG. 5 shows the removal of part of the floor lab during installation of the channel means of this invention;

FIG. 6 discloses the channel means of this invention being located in position for initial pouring or repouring of a segment of the floor slab;

FIG. 7 shows the implacement of ground or gravel fill upon the channel means before the floor slab is poured into place;

FIG. 8 shows the floor slab being poured into position; and

FIG. 9 shows the channel means of this invention with its flush out tube located at one end of the footing.

DESCRIPTION OF THE PREFERRED EMBODIMENT

In referring to the drawings, and in particular FIG. 1, the hydrochannel means 1 of this invention is disclosed, and as previously explained, generally may be formed as an extruded member, either formed of polymer, rubber, or even of a non-corrosive metal, as may be desired. But, the structure of the invention, as also can be seen from FIG. 2, is generally in the shape of an angle means 2 formed having an upper wall 3, and in integral upright wall 4, generally forming a cavity, as at 5, between the channel means, and a wall against which it rests, and the footing upon which it is installed. It is through this cavity that moisture may permeate, and flow, either to provide for discharge of any accumulated ground water, or to accommodate any flush out at may be required, at this location. Extending horizontally away from the bottom edge of the upright wall 4 is a lower flange 6, and which is designed for resting upon the footing, as can be noted, to provide stability in the installation of this invention. Extending upwardly from the edge 7, and integrally therewith, is the upright flange 8, and which is designed for resting against the vertical surface of the proximate footing, to therein provide for stability in the initial installation of this channel means, but likewise, to furnish some resiliencey to accommodate any expansion of the concrete walls and floors at this location. It is to be noted that the upright flange 8 includes a series of indentations or weakened longitudinally formed grooves, as at 9, to provide for a break off of the upright flange, at one of these locations 9, so that the channel means, or its upper flange 8, need not extend above the upper surface of the poured slab or floor S, once installed.

It can be seen that provided through the vertical wall 4 of the channel means are a series of apertures or slots, as at 10, and these are provided for furnishing openings through which ground water or moisture may flow, to attain access into the cavity 5, during installation and usage of this channel means.

FIGS. 4 through 9 disclose the method of installation of the channel means 1 of this invention, and obviously, where a new foundation, footing, and floor slab are being poured, as in new construction, once the footing and foundation wall have been installed, the channel means of this invention may be arranged at the juncture of the inner surfaces of these components, prior to pouring of the floor slab S, such as shown in FIG. 6. But, when the channel means of this invention is to be installed post construction, as in a building where a serious moisture and ground water problem pervades, then some subsequent construction and modification to the slab S, the foundation wall W, and the footing F, must be undertaken. As can be seen in FIG. 5, a portion of the slab S needs to be removed, so as to disclose the juncture between the footing, and the wall, as at 11. Then, as shown in FIG. 6, the channel means 1 of this invention may be located at this location. Following this, as shown in FIG. 7, some back fill of gravel or chat may be arranged upon the channel means, in order to provide a porous area and medium through which ground water, and moisture, may flow, to attain access to this discharge region. The back fill B is readily disclosed, as shown. Then, as disclosed in FIG. 8, the floor slab S may be repoured at the location of its earlier removal, so as to provide a completed construction, as noted. But, as can also be seen in FIG. 8, the upper segment 12 of the upright flange 8 may extend above the floor slab S, and this particular portion may be broken away, as along one of the weakened lines 9, as previously explained, so that the expansion joint provided through this upright flange may be rather oblivious to view, since its upper edge will terminate at the upper surface or just below of the slab S. Finally, as shown in FIG. 9, a flush out tube T, with or without closure cap C may be arranged to open, at is lower end, into the channel means 2, and through its cavity 5, so that water may be discharged therein, in order to provide for that type of flush out of the tube as previously explained, in order to furnish adequate clearance for entrance of any ground water therein, and eliminate any gravel from within the channel, that may have permeated therein, over a matter of time, which may occur under normal functioning conditions.

The subject matter of this invention as disclosed herein may stimulate consideration of changes or modifications to one skilled in the art after review of the description provided in this disclosure. Such changes or modifications, if within the spirit of this invention, are intended to be encompassed within the scope of any claims to patent protection issuing upon this development. The description of the preferred embodiment set forth herein is done so for illustrative purposes only.

Having thus described the invention what is claimed and desired to be secured by Letters Patent is:

1. An integral channel means for use in conjunction with the construction of a building footing, and a floor slab formed in connection therewith, said channel means provided for furnishing drainage of any moisture generated within the vicinity of the footing, and to provide a clean out of any debris that should enter into the channel means during and subsequent to the formation of said footing, said channel means having an angled portion providing a passageway at the junction of the footing within a foundation wall integrally formed thereon, said angled portion having a lower edge and an upper edge, a base flange integrally formed with and extended from the lower edge of the formed angled portion, an upright flange integrally formed and extended upwardly from the upper edge of the said angled portion of the channel means, said angled portion of the channel means having an upright wall, and said angled portion having an integral horizontal wall formed with said upright wall, said upright wall including at least one aperture therethrough to allow seepage of ground water into the channel means during its installation, said upwardly extending flange having a series of break lines provided horizontally thereof, and providing for the break off and removal of upper segments of said upwardly extending flange in accordance with the height required for the said flange depending upon the thickness of the floor slab poured in conjunction with the formed footing, and wherein said channel means having a length equivalent to the full length of any formed footing.

2. The invention of claim 1 and including a flush out tube connecting with the footing at one end of the disposed channel means, and provided for the entrance of fluid therein to provide clean out of any debris entering into the disposed channel means.

* * * * *